US009541100B2

(12) United States Patent
Shi et al.

(10) Patent No.: US 9,541,100 B2
(45) Date of Patent: Jan. 10, 2017

(54) HYDRAULIC CONTROL VALVE, DUAL-CYLINDER EXTENSION SYSTEM AND AERIAL WORK ENGINEERING MACHINE

(75) Inventors: Xianxin Shi, Jiangsu (CN); Xiaodong Xu, Jiangsu (CN); Demei Kong, Jiangsu (CN); Liangwei Lu, Jiangsu (CN)

(73) Assignee: Xuzhou Heavy Machinery Co., Ltd., Jiangsu (CN)

( * ) Notice: Subject to any disclaimer, the term of this patent is extended or adjusted under 35 U.S.C. 154(b) by 375 days.

(21) Appl. No.: 14/346,212

(22) PCT Filed: Feb. 16, 2012

(86) PCT No.: PCT/CN2012/071203
§ 371 (c)(1),
(2), (4) Date: May 28, 2014

(87) PCT Pub. No.: WO2013/040872
PCT Pub. Date: Mar. 28, 2013

(65) Prior Publication Data

US 2015/0014093 A1 Jan. 15, 2015

(30) Foreign Application Priority Data

Sep. 23, 2011 (CN) ..... 2011 1 0286496

(51) Int. Cl.
*F15B 11/22* (2006.01)
*B66F 17/00* (2006.01)
(Continued)

(52) U.S. Cl.
CPC ..... *F15B 11/22* (2013.01); *B66F 11/04* (2013.01); *B66F 17/006* (2013.01);
(Continued)

(58) Field of Classification Search
CPC ..... F15B 11/22; B66F 11/04; B66F 17/006
(Continued)

(56) References Cited

U.S. PATENT DOCUMENTS 3,657,969 A * 4/1972 Wirkus ..... F15B 11/20 212/349
3,760,688 A * 9/1973 Dummer ..... F15B 11/22 60/701
6,189,432 B1 2/2001 Colarelli et al.

FOREIGN PATENT DOCUMENTS

CN 2066843 12/1990
CN 201027299 2/2008
(Continued)

OTHER PUBLICATIONS

European Search Report issued in EP12834004.9 on Aug. 3, 2015 (7 pages).
(Continued)

*Primary Examiner* — Thomas E Lazo
(74) *Attorney, Agent, or Firm* — Fish & Richardson P.C.

(57) ABSTRACT

A hydraulic control valve, a dual-cylinder extension system and an aerial work engineering machine. The control valve comprises a flow distributing and collecting valve, and control valve body is provided with a first oil opening, a second oil opening and a third oil opening. A first oil opening, a second oil opening and a third oil opening of said flow distributing and collecting valve are respectively communicated with the first oil opening, the second oil opening and the third oil opening of the valve body. The control valve has two working states, wherein, in the first working state, the oil path between the second oil opening and the third oil opening of the valve body is blocked; and in the second working state, the oil path between the second oil opening and the third oil opening of the valve body is opened.

15 Claims, 4 Drawing Sheets

(51) Int. Cl.
*B66F 11/04* (2006.01)
*F15B 21/00* (2006.01)

(52) U.S. Cl.
CPC ... *F15B 21/001* (2013.01); *F15B 2211/31588* (2013.01); *F15B 2211/327* (2013.01); *F15B 2211/4053* (2013.01); *F15B 2211/7057* (2013.01); *F15B 2211/7114* (2013.01); *Y10T 137/87265* (2015.04); *Y10T 137/87507* (2015.04)

(58) Field of Classification Search
USPC ..... 91/514, 515, 533
See application file for complete search history.

(56) References Cited

FOREIGN PATENT DOCUMENTS

| | | | |
|---|---|---|---|
| CN | 201095572 | | 8/2008 |
| CN | 201729641 | | 2/2011 |
| CN | 201729641 U | * | 2/2011 |
| CN | 201792744 | | 4/2011 |
| CN | 201953731 | | 8/2011 |
| CN | 102287411 | | 12/2011 |
| DE | 1222376 | | 8/1966 |
| DE | 9318647 | | 2/1994 |
| DE | 10 2010 025616 | | 2/2011 |
| JP | 61-103004 | | 5/1986 |
| WO | 2009/036562 | | 3/2009 |

OTHER PUBLICATIONS

International Search Report issued in PCT/CN2012/071203 on May 3, 2012.

* cited by examiner

HYDRAULIC CONTROL VALVE, DUAL-CYLINDER EXTENSION SYSTEM AND AERIAL WORK ENGINEERING MACHINE

The present application is the national phase of International Application No. PCT/CN2012/071203, titled "HYDRAULIC CONTROL VALVE, DUAL-CYLINDER EXTENSION SYSTEM AND AERIAL WORK ENGINEERING MACHINE," filed on Feb. 16, 2012, which claims the benefit of priority to Chinese Patent Application No. 201110286496.X, titled "HYDRAULIC CONTROL VALVE, DUAL-CYLINDER TELESCOPIC SYSTEM AND AERIAL WORK ENGINEERING MACHINE," filed with the Chinese State Intellectual Property Office on Sep. 23, 2011, both of which applications are herein incorporated by reference in their entireties.

TECHNICAL FIELD

The present application relates to the technical field of engineering machines, and particularly to a dual-cylinder telescopic control valve of an aerial work engineering machine having a dual-cylinder telescopic system. The present application further relates to a dual-cylinder telescopic system having the control valve and an aerial work engineering machine having the control valve.

BACKGROUND

An aerial work engineering machine, such as an elevating fire engine, is a product having a specialized chassis and mounted with a lifting arm frame, and may be operated by a professional operator to rise to a certain height for aerial rescuing or working.

The lifting arm frame may be divided into several types according to the lifting operation manner, such as a folding arm type, a telescopic arm type, a combined arm type and a self-propelled type. The telescopic arm is formed by two or more sections of box-shaped arms sleeved together, and may be driven by a telescopic cylinder or pulled by a flexible wire rope or a leaf chain to make linear reciprocating motion, and may transport an aerial operator to a higher place for working via a bucket mounted on a head of the telescopic arm.

For example, a fire water cannon is arranged at a top end of the telescopic arm of the elevating fire truck, and mechanisms, such as a working platform, is arranged at the top end of the telescopic arm of the aerial work platform. The operator can control the telescopic arm on the controlling platform to realize aerial work functions, such as spraying water, transporting working personnel, or rescuing.

With the rapid development of the social economy of China, the number of high-rise and super-high-rise buildings is growing rapidly, resulting in unprecedented tremendous challenges in fire extinction and emergency rescue of the high-rise buildings. In China, the development of the elevating fire truck has a tendency of pursuing a higher and higher working altitude, and at the same time, the high-altitude and super-high-altitude elevating fire trucks has higher requirements on the performances of the telescopic system, such as safety, reliability and smoothness.

The telescopic arm of the high-working-altitude elevating fire truck has a long stroke and has large numbers of sections, thus a single-cylinder and multi-stage telescopic-chain-type synchronous telescopic control system has been unable to meet the requirements for safety and stability. And for a telescopic system having two or more telescopic cylinders, the telescopic cylinders have to be controlled synchronously so as to reach the maximum working height in the shortest action time to perform the rescue operation quickly.

None of the existing elevating fire trucks using a dual-cylinder telescopic system are provided with a synchronous control valve, and the motion of the telescopic cylinders is controlled directly by a solenoid directional valve group.

Reference is made to FIG. 1, which is a hydraulic schematic diagram of the solenoid directional valve group of the existing dual-cylinder telescopic system.

As shown in the Figure, an upper telescopic cylinder 1 is controlled by a first solenoid directional valve 3-1, and a lower telescopic cylinder 2 is controlled by a second solenoid directional valve 3-2. A solenoid directional valve group 3 is formed by the first solenoid directional valve 3-1 and the second solenoid directional valve 3-2, and has oil ports A1 and B1 connected to a larger chamber and a smaller chamber of the upper telescopic cylinder 1 respectively, and oil ports A2 and B2 connected to a larger chamber and a smaller chamber of the lower telescopic cylinder 2 respectively. Theoretically, the upper telescopic cylinder 1 and the lower telescopic cylinder 2 can be controlled to extend or retract synchronously as long as the first solenoid directional valve 3-1 and the second solenoid directional valve 3-2 are synchronously switched to the left position or the right position.

However in fact, since the load on the lower telescopic cylinder 2 is much larger than the load on the upper telescopic cylinder 1, the extending and retracting motion of the two cylinders may have two circumstances. Taking the extending motion as an example, if the system flow is large enough, the two cylinders may extend synchronously, but the upper telescopic cylinder 1 will have an extending speed faster than the lower telescopic cylinder 2 and will reach the end of the stroke earlier. In contrast, if the system flow is small, the pressure oil will firstly push the upper telescopic cylinder 1 with a smaller load to extend via the directional valve, and after the upper telescopic cylinder 1 reaches the end, the system pressure increases, and then the pressure oil will continue to push the lower telescopic cylinder 2 to extend till the lower telescopic cylinder 2 reaches the end.

This kind of control systems have disadvantages that, the synchronous extension and retraction of the two cylinders can not be realized, and the two telescopic cylinders are controlled separately to extend to the end of the stroke in sequence, which may cause an overlong action time of the telescopic system, and further affect efficiencies of rescue operation and work.

Therefore, a technical problem to be solved by those skilled in the art is to control two cylinders of the dual-cylinder telescopic system to extend and retract synchronously so as to shorten the action time of the telescopic system and improve the working efficiency.

SUMMARY

The present application provides a hydraulic control valve, which may control two cylinders of a dual-cylinder telescopic system to extend and retract synchronously so as to shorten the action time of the telescopic system and improve the working efficiency.

The present application further provides a dual-cylinder telescopic system having the hydraulic control valve.

The present application further provides an aerial work engineering machine having the hydraulic control valve.

A hydraulic control valve according to the present application includes a flow divider and combiner, wherein a valve body of the hydraulic control valve has a first oil port, a second oil port and a third oil port;

the flow divider and combiner has a first oil port, a second oil port and a third oil port which are respectively communicated with the first oil port, the second oil port and the third oil port of the valve body; and the control valve has a first operating state and a second operating state:

in the first operating state, an oil path between the second oil port and the third oil port of the valve body is blocked; and in the second operating state, the oil path between the second oil port and the third oil port of the valve body is opened.

Preferably, the valve body of the control valve has a fourth oil port, and the control valve has a third operating state and a fourth operating state:

in the third operating state, the third oil port and the fourth oil port of the valve body are communicated with each other; and in the fourth operating state, the second oil port and the fourth oil port of the valve body are communicated with each other.

Preferably, the valve body has a directional valve and a stop valve;

in the second operating state, the oil path between the second oil port and the third oil port of the valve body is opened via the directional valve; in the third operating state, the third oil port and the fourth oil port of the valve body are communicated with each other via the directional valve; and in the fourth operating state, the second oil port and the fourth oil port of the valve body are communicated with each other via the stop valve.

Preferably, the directional valve has a first oil port, a second oil port and a third oil port which are respectively communicated with the fourth oil port, the second oil port and the third oil port of the valve body; and the directional valve has first, second and third operating positions: in the first operating position, each of the first oil port, the second oil port and the third oil port of the directional valve is closed; in the second operating position, the first oil port of the directional valve is closed, and the second oil port and the third oil port of the directional valve are communicated with each other; and in the third operating position, the second oil port of the directional valve is closed, and the first oil port and the third oil port of the directional valve are communicated with each other.

Preferably, the directional valve is a three-position three-way solenoid directional valve.

Preferably, the directional valve has a first oil port, a second oil port and a third oil port, which are respectively communicated with the fourth oil port, the second oil port and the third oil port of the valve body, and a closed fourth oil port; and the directional valve has first, second and third operating positions: in the first operating position, each of the first oil port, the second oil port, the third oil port and the fourth oil port of the directional valve is closed; in the second operating position, the first oil port and the fourth oil port of the directional valve are communicated with each other, and the second oil port and the third oil port of the directional valve are communicated with each other; and in the third operating position, the first oil port and the third oil port of the directional valve are communicated with each other, and the second oil port and the fourth oil port of the directional valve are communicated with each other.

Preferably, the directional valve is a three-position four-way solenoid directional valve.

The present application further provides a dual-cylinder telescopic system, including an upper telescopic cylinder and a lower telescopic cylinder, and further including the hydraulic control valve described above, wherein a valve body of the hydraulic control valve has a first oil port acting as a control oil port, and a second oil port and a third oil port which are respectively communicated with rodless chambers of the upper telescopic cylinder and the lower telescopic cylinder.

The present application further provides an aerial work engineering machine, including a chassis, a lift arm, an upper telescopic cylinder and a lower telescopic cylinder, and further including the hydraulic control valve described above, wherein a valve body of the hydraulic control valve has a first oil port acting as a control oil port, and a second oil port and a third oil port which are respectively communicated with rodless chambers of the upper telescopic cylinder and the lower telescopic cylinder.

Preferably, the aerial work engineering machine is an elevating fire truck or an aerial work platform.

The hydraulic control valve according to the present application includes a flow divider and combiner, wherein a valve body of the hydraulic control valve has a first oil port, a second oil port and a third oil port; the flow divider and combiner has a first oil port, a second oil port and a third oil port which are respectively communicated with the first oil port, the second oil port and the third oil port of the valve body; and the control valve has a first operating state and a second operating state: in the first operating state, an oil path between the second oil port and the third oil port of the valve body is blocked;

and in the second operating state, the oil path between the second oil port and the third oil port of the valve body is opened.

The control valve has a simple structure, good stability and high safety. In operation, the first oil port of the valve body of the control valve acts as a control oil port, and the second oil port and the third oil port thereof are respectively communicated with rodless chambers of the upper telescopic cylinder and the lower telescopic cylinder of the dual-cylinder telescopic system.

When the upper telescopic cylinder and the lower telescopic cylinder extend or retract, the control valve is in the first operating state, i.e., the oil path between the second oil port and the third oil port of the valve body is blocked, and the flow divider and combiner in the control valve can keep the flow inputted into (or outputted from) the second oil port equal to the flow inputted into (or outputted from) the third oil port without considering errors and other external interference factors, thus the two telescopic cylinders may be driven to extend or retract synchronously so as to enable the telescopic system to complete the extension or retraction in the shortest time, thereby greatly improving the working efficiency.

When the two cylinders can not extend to the end or retract to the starting point synchronously due to various flow error factors such as load difference, error of the flow divider and combiner, the control valve is in the second operating state, wherein the oil path between the second oil port and the third oil port of the valve body is opened, such that the lag telescopic cylinder may extend to the end of the stroke or retract to the starting point quickly, thereby ensuring that each of the telescopic cylinders may move in place accurately.

In an embodiment, the valve body of the control valve has a fourth oil port, and the control valve has a third operating state and a fourth operating state: in the third operating state, the third oil port and the fourth oil port of the valve body are communicated with each other; and in the fourth operating state, the second oil port and the fourth oil port of the valve body are communicated with each other.

The fourth oil port of the valve body acts as an oil returning port, and the second oil port or the third oil port of the valve body is communicated with the oil returning circuit so as to separately supply oil for the upper telescopic cylinder and the lower telescopic cylinder, thereby controlling the telescopic cylinders to extend or retract separately. In this way, the control valve has functions for controlling the two cylinders to extend or retract synchronously and controlling the two cylinders to extend or retract separately, which may meet the requirements for various operating conditions, such as vehicle debugging, fault diagnosis, or single cylinder stress calculation.

The dual-cylinder telescopic system and the aerial work engineering machine according to the present application are both provided with the hydraulic control valve described above. Since the hydraulic control valve has the above technical effects, the dual-cylinder telescopic system and the aerial work engineering machine with the hydraulic control valve also have the corresponding technical effects.

Figure 1:
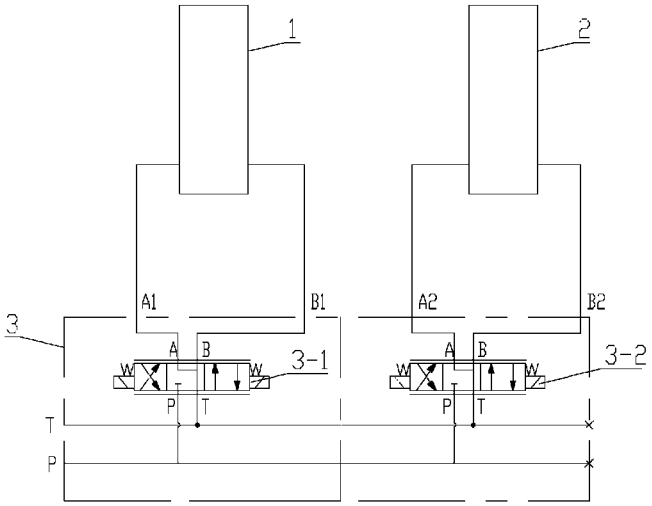
FIG. 1 is a hydraulic schematic diagram of a solenoid directional valve group of an existing dual-cylinder telescopic system.

Reference numerals in FIG. 1:

| | | | |
|---|---|---|---|
| 1 | upper telescopic cylinder, | 2 | lower telescopic cylinder, |
| 3 | solenoid directional valve group, | 3-1 | first solenoid directional valve, |
| 3-2 | second solenoid directional valve; | | |

Reference numerals in FIGS. 2 to 8:

| | | | |
|---|---|---|---|
| 10 | valve body, | V | first oil port, |
| C1 | second oil port, | C2 | third oil port, |
| T | fourth oil port; | | |
| 10-1 | flow divider and combiner; | | |
| 10-2 | two-position two-way solenoid directional valve; | | |
| 10-3 | three-position three-way solenoid directional valve, | | |
| T | first oil port, | P | second oil port, |
| B | third oil port; | | |
| 10-4 | three-position four-way solenoid directional valve, | | |
| T | first oil port, | P | second oil port, |
| B | third oil port, | A | fourth oil port; |
| 10-5 | first stop valve, | 10-6 | second stop valve, |
| 10-7 | third stop valve, | 10-8 | fourth stop valve; |
| 20-1 | upper telescopic cylinder, and | 20-2 | lower telescopic cylinder. |

DETAILED DESCRIPTION

The present application provides a hydraulic control valve, which may control two cylinders of a dual-cylinder telescopic system to extend and retract synchronously so as to shorten the action time of the telescopic system and improve the working efficiency.

The present application further provides a dual-cylinder telescopic system having the hydraulic control valve, and an aerial work engineering machine having the hydraulic control valve.

For those skilled in the art to better understand technical solutions of the present application, the present application is described in detail in conjunction with drawings and embodiments hereinafter.

Figure 2:
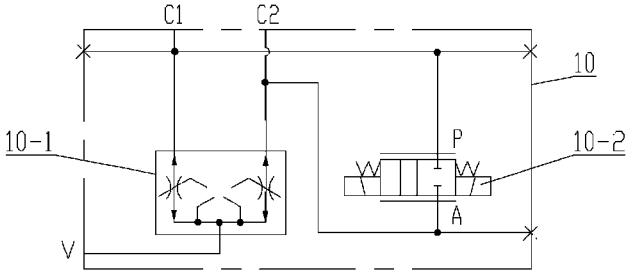
FIG. 2 is a hydraulic schematic diagram of a hydraulic control valve according to a first embodiment of the present application.

Reference is made to FIG. 2, which is a hydraulic schematic diagram of a hydraulic control valve according to a first embodiment of the present application.

In the first embodiment, the hydraulic control valve according to the present application is a combination valve, which includes a flow divider and combiner 10-1 and a two-position two-way solenoid directional valve 10-2, and a valve body 10 of the hydraulic control valve has a first oil port V, a second oil port C1 and a third oil port C2. The flow divider and combiner 10-1 has a first oil port (i.e. an oil inlet), a second oil port and a third oil port which are respectively communicated with the first oil port V, the second oil port C1 and the third oil port C2 of the valve body 10.

The control valve has a first operating state and a second operating state.

In the first operating state, an oil path between the second oil port C1 and the third oil port C2 of the valve body 10 is blocked.

In the second operating state, the oil path between the second oil port C1 and the third oil port C2 of the valve body 10 is opened via the two-position two-way solenoid directional valve 10-2.

In operation, the first oil port V of the valve body 10 is a control oil port, and the second oil port C1 and the third oil port C2 communicate with rodless chambers of an upper telescopic cylinder and a lower telescopic cylinder of a dual-cylinder telescopic system, respectively. The operating process is as follows.

When the telescopic cylinders are required to extend, the hydraulic control valve is in the first operating state. The control oil port of the hydraulic system supplies oil to the first oil port V, and after being divided by the flow divider and combiner 10-1 in the valve body 10, the oil enters into the two telescopic cylinders via the second oil port C1 and the third oil port C2 respectively, then the two telescopic cylinders extend. Here, the flow divider and combiner 10-1 has a flow dividing function for dividing the system flow into two equal parts, which are supplied to the two telescopic cylinders to drive the two cylinders to extend synchronously.

In actual process, the flows distributed to the two telescopic cylinders are not completely equal due to several factors, such as different forces applied on the two telescopic cylinders, uneven load frictions, the error of the flow divider and combiner. Thus, one of the telescopic cylinders will reach the end of the stroke firstly. Due to the construction features of the flow divider and combiner 10-1, a build-up pressure of the hydraulic cylinder may be caused when one telescopic cylinder reaches the end of the stroke, then the pressure increases sharply, and the oil port (the second oil port C1 or the third oil port C2), through which the oil is supplied to a lag cylinder by the flow divider and combiner, will be sharply reduced or closed, thus the lag cylinder will stop action and can not fully extend. If such situation happens in an elevating fire truck, the arm of the elevating fire truck cannot reach the specified operating height.

At this time, the hydraulic control valve is in the second operating state. When one of the telescopic cylinders reaches the end of the stroke, the two-position two-way solenoid directional valve 10-2 is energized to connect the left position (i.e. ports P and A are connected), such that the second oil port C1 and the third oil port C2 of the flow divider and combiner 10-1 are communicated with each other and have equal pressures, and the second oil port C1 and the third oil port C2 return to the normal open state, and the flow from the flow divider and combiner 10-1 will be completely supplied to the lag cylinder to drive it to reach the end of the stroke quickly.

When the telescopic cylinders are required to retract, the hydraulic control valve is in the first operating state. The second oil port C1 and the third oil port C2 are oil returning ports, and after being combined by the flow divider and combiner 10-1 in the valve body, the oil flows back to the control oil port of the hydraulic system via the first oil port V, and the telescopic cylinders retract. Here, the flow divider and combiner 10-1 has a flow combining function for keeping the flows inputted in the second oil port C1 and the third oil port C2 equal, thereby driving the two cylinders to retract synchronously.

Similarly, in actual process, the flow rates of the oils flowing into the second oil port C1 and the third oil port C2 are not completely equal due to several factors, such as different forces applied on the two telescopic cylinders, uneven load frictions, the error of the flow divider and combiner. Thus, one of the telescopic cylinders will retract to the starting point of the stroke firstly, and at this time, an outlet pressure of the telescopic cylinder will be reduced to zero sharply, and the oil port (the second oil port C1 or the third oil port C2), through which the oil in the lag telescopic cylinder enters the flow divider and combiner 10-1, will be sharply reduced or closed, thus the lag telescopic cylinder will stop action and can not fully retract. If the above situation happens to the elevating fire truck, the arm thereof cannot retract to the original position and the truck cannot return to the original state normally.

At this time, the hydraulic control valve is in the second operating state. When one of the telescopic cylinders returns to the starting point, the two-position two-way solenoid directional valve 10-2 is energized to connect the left position (i.e. ports P and A are connected), such that the pressures at the second oil port C1 and the third oil port C2 of the flow divider and combiner 10-1 are equal, and the second oil port C1 and the third oil port C2 may return to the normal open state, thus the oil in the telescopic cylinder, which is not fully retracted, will flow through both the second oil port C1 and the third oil port C2 and be combined in the first oil port V via the flow divider and combiner 10-1 to flow back, thus the telescopic cylinder, which is not fully retracted, may retract to the starting point of the stroke quickly.

Figure 3:
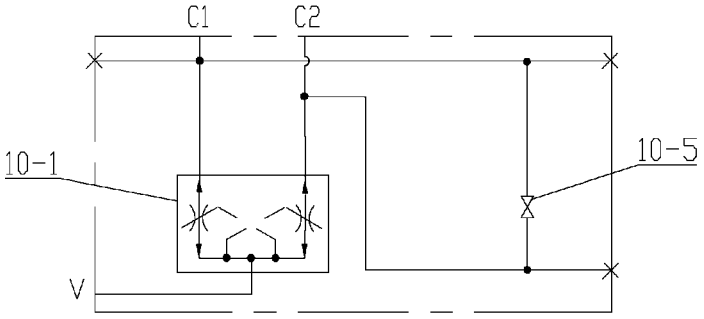
FIG. 3 is a hydraulic schematic diagram of a hydraulic control valve according to a second embodiment of the present application.

Reference is made to FIG. 3, which is a hydraulic schematic diagram of a hydraulic control valve according to a second embodiment of the present application.

Since the two-position two-way solenoid directional valve 10-2 in the hydraulic control valve of the first embodiment functions to open or close the second oil port C1 and the third oil port C2 (i.e. the second oil port and the third oil port of the flow divider and combiner) of the valve body, in the second embodiment, a first stop valve 10-5 is used to replace the two-position two-way solenoid directional valve 10-2. The first stop valve 10-5 and the two-position two-way solenoid directional valve 10-2 have basically the same function of controlling the oil path, thus both can drive the two cylinders to extend or retract in place.

Figure 4:
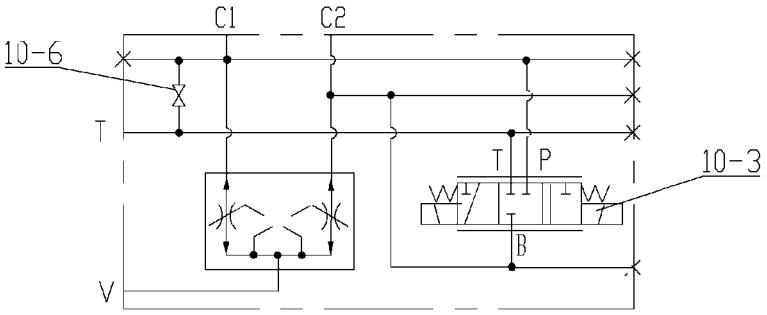
FIG. 4 is a hydraulic schematic diagram of a hydraulic control valve according to a third embodiment of the present application.

Reference is made to FIG. 4, which is a hydraulic schematic diagram of a hydraulic control valve according to a third embodiment of the present application.

In the third embodiment, the control valve according to the present application is a combination valve, which includes a flow divider and combiner 10-1, a second stop valve 10-6 and a three-position three-way solenoid directional valve 10-3, and the valve body 10 of the control valve has a first oil port V, a second oil port C1, a third oil port C2 and a fourth oil port T.

The flow divider and combiner 10-1 has a first oil port (i.e. an oil inlet), a second oil port and a third oil port which are respectively communicated with the first oil port V, the second oil port C1 and the third oil port C2 of the valve body.

The second stop valve 10-6 has two oil ports which are respectively communicated with the second oil port C1 and the fourth oil port T of the valve body 10.

The three-position three-way solenoid directional valve 10-3 has a first oil port T, a second oil port P and a third oil port B which are respectively communicated with the fourth oil port T, the second oil port C1 and the third oil port C2 of the valve body 10.

The control valve has the following four operating states.

In a first operating state, the second stop valve 10-6 is disconnected, the three-position three-way solenoid directional valve 10-3 is in a middle position, and an oil path between the second oil port C1 and the third oil port C2 of the valve body 10 is blocked.

In a second operating state, the second stop valve 10-6 is disconnected, the three-position three-way solenoid directional valve 10-3 is in a left position, and the oil path between the second oil port C1 and the third oil port C2 of the valve body 10 is opened through the third oil port B and the second oil port P of the three-position three-way solenoid directional valve 10-3.

In a third operating state, the second stop valve 10-6 is disconnected, the three-position three-way solenoid directional valve 10-3 is in a right position, the oil path between the second oil port C1 and the third oil port C2 of the valve body 10 is blocked, and the third oil port C2 of the valve body 10 communicates with the fourth oil port T of the valve body 10 through the first oil port T and the third oil port B of the three-position three-way solenoid directional valve 10-3.

In a fourth operating state, the second stop valve 10-6 is connected, the three-position three-way solenoid directional valve 10-3 is in the middle position, the oil path between the second oil port C1 and the third oil port C2 of the valve body 10 is blocked, and the second oil port C1 of the valve body 10 communicates with the fourth oil port T of the valve body 10 through the second stop valve 10-6.

In operation, the first oil port V of the valve body 10 is a control oil port, and the second oil port C1 and the third oil port C2 of the valve body 10 respectively communicate with rodless chambers of an upper telescopic cylinder and a lower telescopic cylinder of a dual-cylinder telescopic system. The operating process is as follows.

When the telescopic cylinders are required to extend, the hydraulic control valve is in the first operating state. The control oil port of the hydraulic system supplies oil to the first oil port V, and after being divided by the flow divider and combiner 10-1 in the valve body, the oil enters into the two telescopic cylinders via the second oil port C1 and the third oil port C2 respectively, thereby driving the two cylinders to extend synchronously.

When one of the telescopic cylinders reaches the end of the stroke, the hydraulic control valve is in the second operating state. At this time, the three-position three-way solenoid directional valve 10-3 is energized to connect the left position (i.e. ports P and B are connected), such that the second oil port and the third oil port of the flow divider and combiner 10-1 are communicated with each other and have equal pressures, and the second oil port and the third oil port return to the normal open state, thereby driving the lag telescopic cylinder to reach the end of the stroke quickly.

When the telescopic cylinders are required to retract, the hydraulic control valve is in the first operating state. The second oil port C1 and the third oil port C2 are oil returning ports, and after being combined by the flow divider and combiner 10-1 in the valve body 10, the oil flows back to the control oil port of the hydraulic system via the first oil port V, thereby driving the two cylinders to retract synchronously.

When one of the telescopic cylinders returns to the starting point, the hydraulic control valve is in the second operating state. At this time, the three-position three-way solenoid directional valve 10-3 is energized to connect the left position, thus the second oil port and the third oil port of the flow divider and combiner 10-1 have equal pressures, and return to the normal open state, thereby driving the telescopic cylinder, which is not fully retracted, to retract to the starting point of the stroke quickly.

The two cylinders may be required to extend or retract separately for debugging, fault diagnosis, single cylinder stress calculation or other reasons. For example, when it needs to run an loaded experiment test or a stress test on the lower telescopic cylinder moving separately, the three-position three-way solenoid directional valve 10-3 in the hydraulic control valve is energized to connect the right position, then the first oil port T communicates with the third oil port B, and the pressure oil flowing from the third oil port of the flow divider and combiner 10-1 flows through the first oil port T and the third oil port B and flows back to an oil tank directly via the fourth oil port T of the valve body 10, which is equivalent to short-circuit the upper telescopic cylinder in the hydraulic oil path, while the pressure oil flowing from the second oil port of the flow divider and combiner 10-1 still enters into the lower telescopic cylinder to push it to extend, thereby realizing the separate action of the lower telescopic cylinder.

When the upper telescopic cylinder is required to move separately, the second stop valve 10-6 in the hydraulic control valve is connected, and the three-position three-way solenoid directional valve 10-3 is de-energized. In this way, the pressure oil flowing from the second oil port of the flow divider and combiner 10-1 flows back to the oil tank directly via the second stop valve 10-6, which is equivalent to short-circuit the lower telescopic cylinder in the hydraulic oil path, and the pressure oil flowing from the third oil port of the flow divider and combiner 10-1 still enters into the upper telescopic cylinder to push it to extend, thereby realizing the separate action of the upper telescopic cylinder.

Figure 5:
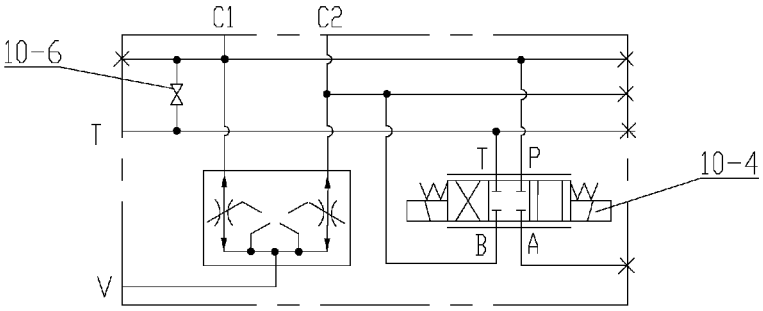
FIG. 5 is a hydraulic schematic diagram of a hydraulic control valve according to a fourth embodiment of the present application.

Reference is made to FIG. 5, which is a hydraulic schematic diagram of a hydraulic control valve according to a fourth embodiment of the present application.

Unlike the third embodiment, the directional valve in the hydraulic control valve according to the fourth embodiment of the present application is a three-position four-way solenoid directional valve 10-4, which has a first oil port T, a second oil port P and a third oil port B respectively communicated with a fourth oil port T, a second oil port C1 and a third oil port C2 of the valve body 10, and a closed fourth oil port A.

The three-position four-way solenoid directional valve 10-4 has the following three operating positions. In a first operating position, the first oil port T, the second oil port P, the third oil port B and the fourth oil port A are all closed; in a second operating position, the first oil port T communicates with the fourth oil port A, and the second oil port P communicates with the third oil port B; and in a third operating position, the first oil port T communicates with the third oil port B, and the second oil port P communicates with the fourth oil port A.

Other structures and operating principle of the fourth embodiment are substantially the same as that of the third embodiment, which will not be repeated herein for simplicity.

Figure 6:
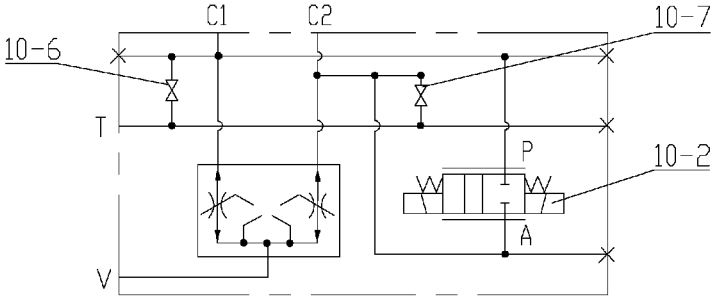
FIG. 6 is a hydraulic schematic diagram of a hydraulic control valve according to a fifth embodiment of the present application.
Figure 7:
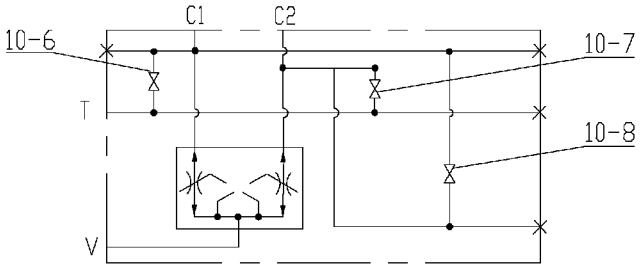
FIG. 7 is a hydraulic schematic diagram of a hydraulic control valve according to a sixth embodiment of the present application.

Reference is made to FIG. 6, which is a hydraulic schematic diagram of a hydraulic control valve according to a fifth embodiment of the present application.

Since the directional valves of the third and fourth embodiments in the hydraulic control valve function to connect or disconnect the second oil port C1 and the third oil port C2 of the valve body 10, and to connect or disconnect the third oil port C2 and the fourth oil port T, a two-position two-way solenoid directional valve 10-2 and a third stop valve 10-7 can be used to replace the three-position three-way solenoid directional valve 10-3 or the three-position four-way solenoid directional valve 10-4.

As shown in the Figure, two oil ports of the two-position two-way solenoid directional valve 10-2 communicate with the second oil port C1 and the third oil port C2 of the valve body 10 respectively, and two oil ports of the third stop valve 10-7 communicate with the third oil port C2 and the fourth oil port T of the valve body 10 respectively, thereby also realizing objects of driving the two cylinders to extend or retract in place synchronously and driving the two cylinders to extend or retract separately.

The hydraulic control valve described above is only a preferable solution, and the specific structure thereof is not limited to this and can be adjusted according to actual requirements to obtain different embodiments. For example, the two-position two-way solenoid directional valve 10-2 of the fifth embodiment may be replaced by a fourth stop valve 10-8 (see FIG. 7).

Therefore, in order to make the hydraulic control valve to be in respective operating states accurately, the directional valve can be of various types, and the stop valve and the directional valve also have various combination manners in a hydraulic oil path, which will not be illustrated herein for simplicity since there are various implementations.

Figure 8:
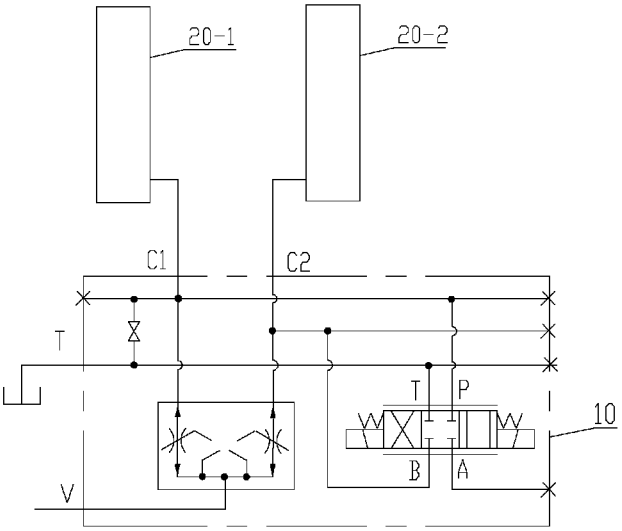
FIG. 8 is a hydraulic schematic diagram of the hydraulic control valve in FIG. 6 being connected to an upper telescopic cylinder and a lower telescopic cylinder of a dual-cylinder telescopic system.

Reference is made to FIG. 8, which is a hydraulic schematic diagram of the hydraulic control valve in FIG. 6 being connected to an upper telescopic cylinder and a lower telescopic cylinder of a dual-cylinder telescopic system.

The present application further provides a dual-cylinder telescopic system, including an upper telescopic cylinder 20-1 and a lower telescopic cylinder 20-2, and further including the hydraulic control valve of the fifth embodiment. A valve body 10 of the hydraulic control valve has a first oil port V acting as a control oil port, a second oil port C1 and a third oil port C2 respectively communicated with rodless chambers of the upper telescopic cylinder 20-1 and the lower telescopic cylinder 20-2, and a fourth oil port T acting as an oil returning port. Other structures of the dual-cylinder telescopic system may be referred to the prior art.

It is to be explained that, since each of the upper telescopic cylinder 20-1 and the lower telescopic cylinder 20-2 of the dual-cylinder telescopic system is a single-acting cylinder, the hydraulic control valve according to the present application is only arranged in the oil path of the rodless chamber thereof. If each of the upper telescopic cylinder 20-1 and the lower telescopic cylinder 20-2 is a double-acting cylinder, the hydraulic control valve can also be arranged in the oil path of the rod chamber thereof.

In addition to the hydraulic control valve and the dual-cylinder telescopic system described above, the present application further provides an aerial work engineering machine, which includes a chassis, a lift arm, an upper telescopic cylinder 20-1 and a lower telescopic cylinder 20-2, and further includes the hydraulic control valve described above. A valve body 10 of the hydraulic control valve has a first oil port V acting as a control oil port, a second oil port C1 and a third oil port C2 respectively communicated with rodless chambers of the upper telescopic cylinder 20-1 and the lower telescopic cylinder 20-2, and a fourth oil port T acting as an oil returning port. Other structures of the aerial work engineering machine may be referred to the prior art.

The aerial work engineering machine is an elevating fire truck or an aerial operation platform.

A hydraulic control valve, a dual-cylinder telescopic system and an aerial work engineering machine according to the present application are described in detail hereinbefore. The principle and the embodiments of the present application are illustrated herein by specific examples. The above description of examples is only intended to help the understanding of the concept of the present application. It should be noted that, for the person skilled in the art, many modifications and improvements may be made to the present application without departing from the principle of the present application, and these modifications and improvements are also deemed to fall into the protection scope of the present application defined by the claims.

The invention claimed is:

1. A hydraulic control valve, comprising a flow divider and combiner, wherein a valve body of the hydraulic control valve has a first oil port, a second oil port and a third oil port;

the flow divider and combiner has a first oil port, a second oil port and a third oil port which are respectively communicated with the first oil port, the second oil port and the third oil port of the valve body;

the control valve has a first operating state and a second operating state:

in the first operating state, an oil path between the second oil port and the third oil port of the valve body is blocked; and in the second operating state, the oil path between the second oil port and the third oil port of the valve body is opened; and the valve body of the control valve has a fourth oil port, and the control valve has a third operating state and a fourth operating state:

in the third operating state, the third oil port and the fourth oil port of the valve body are communicated with each other; and in the fourth operating state, the second oil port and the fourth oil port of the valve body are communicated with each other.

2. The hydraulic control valve according to claim 1, wherein the valve body has a directional valve and a stop valve;

in the second operating state, the oil path between the second oil port and the third oil port of the valve body is opened via the directional valve; in the third operating state, the third oil port and the fourth oil port of the valve body are communicated with each other via the directional valve; and in the fourth operating state, the second oil port and the fourth oil port of the valve body are communicated with each other via the stop valve.

3. The hydraulic control valve according to claim 2, wherein the directional valve has a first oil port, a second oil port and a third oil port which are respectively communicated with the fourth oil port, the second oil port and the third oil port of the valve body; and the directional valve has first, second and third operating positions: in the first operating position, each of the first oil port, the second oil port and the third oil port of the directional valve is closed; in the second operating position, the first oil port of the directional valve is closed, and the second oil port and the third oil port of the directional valve are communicated with each other; and in the third operating position, the second oil port of the directional valve is closed, and the first oil port and the third oil port of the directional valve are communicated with each other.

4. The hydraulic control valve according to claim 3, wherein the directional valve is a three-position three-way solenoid directional valve.

5. The hydraulic control valve according to claim 2, wherein the directional valve has a first oil port, a second oil port and a third oil port, which are respectively communicated with the fourth oil port, the second oil port and the third oil port of the valve body, and a closed fourth oil port; and the directional valve has first, second and third operating positions: in the first operating position, each of the first oil port, the second oil port, the third oil port and the fourth oil port of the directional valve is closed; in the second operating position, the first oil port and the fourth oil port of the directional valve are communicated with each other, and the second oil port and the third oil port of the directional valve are communicated with each other; and in the third operating position, the first oil port and the third oil port of the directional valve are communicated with each other, and the second oil port and the fourth oil port of the directional valve are communicated with each other.

6. The hydraulic control valve according to claim 5, wherein the directional valve is a three-position four-way solenoid directional valve.

7. A dual-cylinder telescopic system, comprising an upper telescopic cylinder and a lower telescopic cylinder, and further comprising a hydraulic control valve, wherein a valve body of the hydraulic control valve has a first oil port acting as a control oil port, and a second oil port and a third oil port which are respectively communicated with rodless chambers of the upper telescopic cylinder and the lower telescopic cylinder; and the hydraulic control valve comprises a flow divider and combiner, wherein the flow divider and combiner has a first oil port, a second oil port and a third oil port which are respectively communicated with the first oil port, the second oil port and the third oil port of the valve body;

the control valve has a first operating state and a second operating state:

in the first operating state, an oil path between the second oil port and the third oil port of the valve body is blocked; and in the second operating state, the oil path between the second oil port and the third oil port of the valve body is opened; and the valve body of the control valve has a fourth oil port, and the control valve has a third operating state and a fourth operating state:

in the third operating state, the third oil port and the fourth oil port of the valve body are communicated with each other; and in the fourth operating state, the second oil port and the fourth oil port of the valve body are communicated with each other.

8. The dual-cylinder telescopic system according to claim 7, wherein the valve body has a directional valve and a stop valve;

in the second operating state, the oil path between the second oil port and the third oil port of the valve body is opened via the directional valve; in the third operating state, the third oil port and the fourth oil port of the valve body are communicated with each other via the directional valve; and in the fourth operating state, the second oil port and the fourth oil port of the valve body are communicated with each other via the stop valve.

9. The dual-cylinder telescopic system according to claim 8, wherein the directional valve has a first oil port, a second oil port and a third oil port which are respectively communicated with the fourth oil port, the second oil port and the third oil port of the valve body; and the directional valve has first, second and third operating positions: in the first operating position, each of the first oil port, the second oil port and the third oil port of the directional valve is closed; in the second operating position, the first oil port of the directional valve is closed, and the second oil port and the third oil port of the directional valve are communicated with each other; and in the third operating position, the second oil port of the directional valve is closed, and the first oil port and the third oil port of the directional valve are communicated with each other.

10. The dual-cylinder telescopic system according to claim 8, wherein the directional valve has a first oil port, a second oil port and a third oil port, which are respectively communicated with the fourth oil port, the second oil port and the third oil port of the valve body, and a closed fourth oil port; and the directional valve has first, second and third operating positions: in the first operating position, each of the first oil port, the second oil port, the third oil port and the fourth oil port of the directional valve is closed; in the second operating position, the first oil port and the fourth oil port of the directional valve are communicated with each other, and the second oil port and the third oil port of the directional valve are communicated with each other; and in the third operating position, the first oil port and the third oil port of the directional valve are communicated with each other, and the second oil port and the fourth oil port of the directional valve are communicated with each other.

11. An aerial work engineering machine, comprising a chassis, a lift arm, an upper telescopic cylinder and a lower telescopic cylinder, and further comprising a hydraulic control valve, wherein a valve body of the hydraulic control valve has a first oil port acting as a control oil port, and a second oil port and a third oil port which are respectively communicated with rodless chambers of the upper telescopic cylinder and the lower telescopic cylinder; and the hydraulic control valve comprises a flow divider and combiner, wherein the flow divider and combiner has a first oil port, a second oil port and a third oil port which are respectively communicated with the first oil port, the second oil port and the third oil port of the valve body;

the control valve has a first operating state and a second operating state:

in the first operating state, an oil path between the second oil port and the third oil port of the valve body is blocked; and in the second operating state, the oil path between the second oil port and the third oil port of the valve body is opened; and the valve body of the control valve has a fourth oil port, and the control valve has a third operating state and a fourth operating state:

in the third operating state, the third oil port and the fourth oil port of the valve body are communicated with each other; and in the fourth operating state, the second oil port and the fourth oil port of the valve body are communicated with each other.

12. The aerial work engineering machine according to claim 11, wherein the aerial work engineering machine is an elevating fire truck or an aerial work platform.

13. The aerial work engineering machine according to claim 11, wherein the valve body has a directional valve and a stop valve;

in the second operating state, the oil path between the second oil port and the third oil port of the valve body is opened via the directional valve; in the third operating state, the third oil port and the fourth oil port of the valve body are communicated with each other via the directional valve; and in the fourth operating state, the second oil port and the fourth oil port of the valve body are communicated with each other via the stop valve.

14. The aerial work engineering machine according to claim 13, wherein the directional valve has a first oil port, a second oil port and a third oil port which are respectively communicated with the fourth oil port, the second oil port and the third oil port of the valve body; and the directional valve has first, second and third operating positions: in the first operating position, each of the first oil port, the second oil port and the third oil port of the directional valve is closed; in the second operating position, the first oil port of the directional valve is closed, and the second oil port and the third oil port of the directional valve are communicated with each other; and in the third operating position, the second oil port of the directional valve is closed, and the first oil port and the third oil port of the directional valve are communicated with each other.

15. The aerial work engineering machine according to claim 13, wherein the directional valve has a first oil port, a second oil port and a third oil port, which are respectively communicated with the fourth oil port, the second oil port and the third oil port of the valve body, and a closed fourth oil port; and the directional valve has first, second and third operating positions: in the first operating position, each of the first oil port, the second oil port, the third oil port and the fourth oil port of the directional valve is closed; in the second operating position, the first oil port and the fourth oil port of the directional valve are communicated with each other, and the second oil port and the third oil port of the directional valve are communicated with each other; and in the third operating position, the first oil port and the third oil port of the directional valve are communicated with each other, and the second oil port and the fourth oil port of the directional valve are communicated with each other.

* * * * *